United States Patent [19]

Bushey

[11] Patent Number: 4,851,051

[45] Date of Patent: Jul. 25, 1989

[54] PROCESS FOR DE-IONIZING SILVER PARTICLES

[75] Inventor: William R. Bushey, Wilmington, Del.

[73] Assignee: E. I. Du Pont de Nemours and Company, Wilmington, Del.

[21] Appl. No.: 242,112

[22] Filed: Sep. 9, 1988

[51] Int. Cl.[4] ..... C23G 1/24

[52] U.S. Cl. ..... 134/2; 134/26; 134/29

[58] Field of Search ..... 134/2, 21, 26, 29; 210/634

[56] References Cited

U.S. PATENT DOCUMENTS 4,284,434 8/1981 Lingmann et al. ..... 134/2
4,602,963 7/1986 Piatkowski ..... 134/2
4,617,063 10/1986 Morris ..... 134/29

*Primary Examiner*—Ivars Cintins

[57] ABSTRACT

Silver particles, which have been treated with an ionic surfactant and thus contain adsorbed ions derived from the surfactant, are de-ionized by exchanging the adsorbed ions with a non-ionic surfactant.

6 Claims, 1 Drawing Sheet

PROCESS FOR DE-IONIZING SILVER PARTICLES

FIELD OF INVENTION

The invention is directed to a process for de-ionizing silver particles which have been treated with an ionic surfactant and, in particular, flake silver particles which have been thusly treated.

BACKGROUND OF THE INVENTION

Finely divided particles of silver are widely used in the electronics industry for the manufacture of thick film pastes which can be used to form conductive circuit patterns in a wide variety of electronic components. In such applications, the thick film pastes are applied by such methods as screen printing and are either dried to remove solvent or dried and fired to effect volatilization of the liquid organic medium from the paste and to effect sintering of the silver particles to form an integral circuit pattern.

Experience in the use of such thick film pastes has taught that conductivity of the final dried and/or fired pastes and thus the specific conductivity of the circuits prepared therefrom can be substantially improved by the use of flake silver particles. For this reason, most of the thick film pastes used throughout the electronics industry employ flakeshaped particles of silver rather than spherical or semi-spherical particles.

Flake silver particles are mainly formed by ball-milling more spherical particles. However, in the ball-milling operations it is necessary in most instances to add to the mass to be milled an amount of surfactant sufficient to prevent the quite maleable silver particles from undergoing cold welding (fusion) as their configuration is changed to flake morphology. The surfactants most used for this purpose are ionic surfactants and particularly anionic surfactants such as the sodium salts of various longchain fatty acids. In particular, the sodium salts of lauryl, palmitic and stearic acids are frequently used.

When ionic surfactants such as those described above are used in the preparation of flake silver particles, the resultant flakes usually contain substantial amounts of sodium ions, which are harmful impurities in many electronic systems prepared from thick film pastes. Some of the ionic impurities are chemisorbed on the flake particles. However, most of the ionic impurities associated with the silver flake particles are in the form of a micelle surrounding a core of silver metal. This micelle of excess surfactant is firmly attached to the silver and acts as a trap which inhibits the removal of the sodium ions from the powder by washing with water. As an illustration of this phenomenon, a typical commercial flake silver product has been found to contain 160–200 ppm residual extractable sodium. Even after repeated washings with de-ionized water, it is reduced to only 50–70 ppm sodium.

Heretofore, it has not been possible substantially to lower the ion content of flake silver without altering the configuration of the particles. Therefore, in view of the increasing need for conductive materials having very low contaminant levels, there is a very real need for flake silver particles having very low ionic contamination. To accomplish this, a process is needed by which surfactant-treated flake silver particles can be de-ionized without adversely affecting the physical characterisitics of the flakes.

SUMMARY OF THE INVENTION

In its primary aspect, the invention is directed to a process for the de-ionization of surfactant-treated silver particles. In particular, the invention is directed to a process for the de-ionization of surfactant-treated silver particles having a chemisorbed primary layer of ionic surfactant surrounded by a micellar secondary layer of ionic surfactant comprising the sequential steps of:

(1) forming a dispersion of non-ionic surfactant having an HLB number of at least 4 in an aqueous liquid medium;

(2) admixing in the dispersion of step (1) finely divided particles of surfactant-treated silver and maintaining a dispersing of both the non-ionic surfactant and silver particles in the aqueous liquid medium for a time sufficient to effect exchange between the dispersed non-ionic surfactant and the ionic surfactant in the micellar layer;

(3) separating surfactant-exchanged silver particles which contain residual water from the aqueous liquid dispersion medium;

(4) washing the separated silver particles from step (3) with de-ionized water to remove ionic surfactant from the residual water; and (5) drying the washed silver particles from step (4).

BRIEF DESCRIPTION OF THE DRAWING

The drawing consists of a single FIGURE which is a graphical correlation of the effects of surfactant polarity and exchange time upon ion removal in the process of the invention. The graph is based upon statistical analysis of the data obtained in Examples 1–12.

DETAILED DESCRIPTION OF THE INVENTION

A. Non-ionic Surfactant

Figure 1:
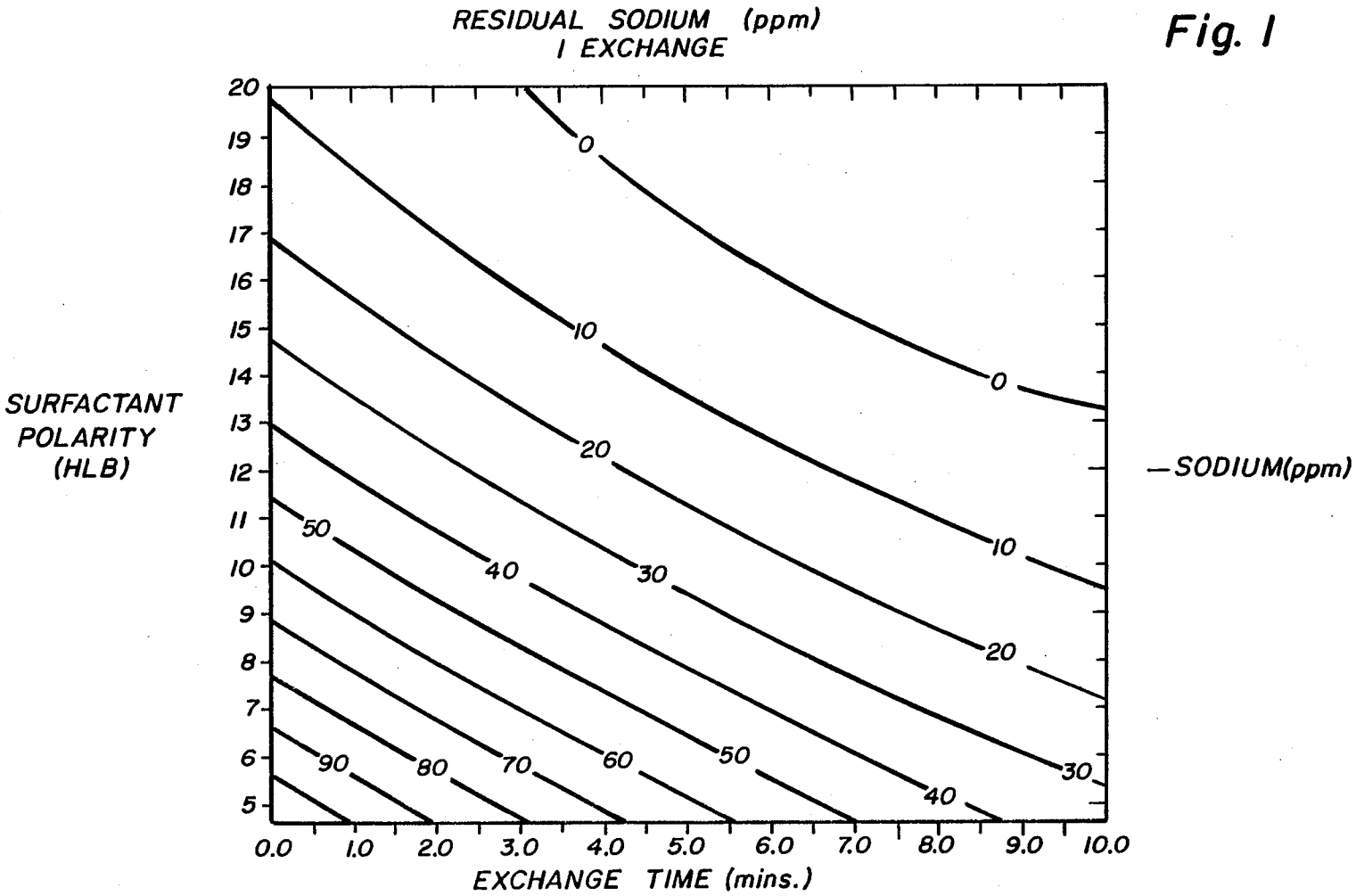

Though it is not necessary that the non-ionic surfactant of the invention be soluble in the dispersion medium, it is nevertheless preferred that it be substantially soluble therein. Non-ionic surfactants which are suitable for use in the process of the invention have an HLB number of at least 4 and are readily dispersible in aqueous media. Because they are readily dispersible in water and more effective in removing the ions, more highly polar non-ionic surfactants having an HLB number of at least 12 are preferred and those having an HLB number of 15–18 are especially preferred. Non-ionic surfactants having still higher HLB numbers are, of course, suitable as well. However, their HLB number is never higher than about 20.

Among the many non-ionic surfactants which can be used in the invention are the following:

Igepal CO 210[1]
Igepal CO 430
Igepal CO 630
Igepal CO 897
Kessco PEG 4000 Dioleate[2]
Kessco PEG 6000 Dioleate
Kessco PEG 6000 Dilaurate
Lipal 23[3]
Lonzest PEG 60 DS[4]
Nopalcol 30—S[5]
Pegosperse 1750-MS[6]

(1) Igepal is a trademark of GAF Corp., New York, N.Y. for a family of alkylphenoxypoly(ethyleneoxy)ethanol non-ionic surfactants.

(2) Kessco is a trademark of the Armak Div. of Akzona, Inc., Chicago, Ill. for non-ionic surfactants which are polyethyleneglycol esters of long chain fatty acids.

(3) Lipal is a trademark of PVO International, Inc., Boonton, N.J. for nonionic surfactants which are polyethyleneglycol esters of long chain fatty acids.

(4) Lonzest is a trademark of Lanza, Inc., Fairlawn, N.J. for non-ionic surfactants which are polyethyleneglycol esters of long chain fatty acids.

(5) Nopalcol is a trademark of Diamond Shamrock Corp., Morristown, N.J. for non-ionic surfactants which are polyethyleneglycol esters of long chain fatty acids.

(6) Pegosperse is a trademark of Glyco Chemicals, Inc., Greenwich, Conn. for non-ionic surfactants which are polyethyleneglycol esters of long chain fatty acids.

B. Flake Silver

The flake silvers for which the process of the invention is intended are commercial grades which have been milled in admixture with a long-chain fatty acid salt. For the purposes of the invention, the cationic moieties of these salts can be an alkaline earth metal or an alkali metal. However, as a practical matter, such commercially available silver particles having flake morphology are almost always treated with the alkaline salts of long-chain fatty acids and in particular sodium salts.

The long-chain moiety of the fatty acid salts will usually be derived from stearic palmitic or lauric acids or mixtures thereof. However, other long fatty acid chains, both natural and synthetic, can be used as well. Nevertheless, the most universally used material for this purpose is technical grade sodium stearate, both because of its effectiveness and its comparatively low cost in technical grades. Technical grade sodium stearate is, in fact, a mixture predominating in sodium stearate but also containing smaller amounts of sodium palmitate and sodium laurate. Other suitable long-chain fatty acids include materials such as oleic acid and linoleic acid.

C. Aqueous Medium

Either de-ionized water or substantially ion-free water-soluble solvents and mixtures thereof can be used as the medium for dispersing the non-ionic surfantant. Mixtures of de-ionized water and such solvents can be used as well. Preferably the aqueous medium should contain no more than about 10 ppm by weight of dissolved ionic species. De-ionized water is by far the most preferred medium. However, solution of watersoluble alcohol and glycols can also be used. Suitable aqueous solvents include $C_{1-3}$ alkanols and alkylene glycols and mixtures thereof with deionized water.

D. Mixing

Though very high shear mixing is not necessary to carry out the invention effectively, the severity of mixing must nevertheless be sufficient physically to break up the anionic surfactant micelle which surrounds the flake silver particles before treatment. Therefore, moderateto-high shear mixing devices can be used. Thus, such dispersion devices as a Waring® blender, Lab Dispersator® or KD® mixer can be used.

In general, the time of mixing is not very critical provided that the power input is sufficient to break up the micelles. However, it has been found that at any given degree of mixing severity, lower HLB (less polar) surfactants take longer to effect a given degree of ion-exchange than those having high HLB numbers.

Likewise, the temperature at which the process of the invention can be carried out is not narrowly critical because the process is carried out wholly in the liquid phase. Thus the process can be conducted at room temperature and does not require either heating or cooling to be more effective. Because temperature is not a critical variable, the process could be carried out with cooling or heating, but usually no process advantage will be obtained thereby.

Thus, if the degree of ion removal for the process is inadequate, even with the use of stoichometric amounts of non-ionic surfactant, the amount of ion removal can be raised by using more contact time with the non-ionic surfactant dispersion.

E. Separation, Washing and Drying

When the desired degree of de-ionization has taken place, the de-ionized flake silver particles are separated from the aqueous medium by conventional means such as filtration and/or centrifugation. The still wet particles from the separation step are then washed one or more times with de-ionized water to remove ions dissolved in the residual water and dried to remove any water which remains on the particles. Finally the wet silver particles are dried by heating either with or without a vacuum or by freeze drying.

F. Test Procedure

Extractable Sodium Analysis: One gram of silver powder is placed in a Parr bomb with 15 ml of de-ionized water. The bomb is heated to 100C for 16 hours. After cooling, the aqueous solution of extracted ions is then analyzed using ion-exchange chromatography. The loading of sodium ion in the silver sample is calculated from the sodium concentration of the water solution by multiplying the ppm sodium in the water by 15.

EXAMPLES

Examples 1–12

A series of statistically designed experiments was performed to identify the most important variables in the surfactant exchange procedure. A commercially available program, "ECHIP", was used to delineate the necessary experiments and the order in which they were to be performed. Three major variables were believed to be of possible importance—the time of surfactant exchange, the number of times the exchange procedure was used, and the polarity of the surfactant (as measured by its HLB number) to be exchanged. A reasonable range for each variable was established and the following experimental conditions were used (see Table 1). A random order of testing was used to insure maximum protection against any unknown systematic error.

Each separate experiment consisted of the following steps: five grams of a non-ionic surfactant (a surfactant synthesized from nonyl phenol and ethylene oxide) was dispersed (or dissolved depending on the solubility of the individual surfactant) in 100 ml of water and placed in a 500 ml high shear blender. Twenty-five grams of silver were added and the blender was operated on for the requisite amount of time. This procedure was repeated 1 to 3 times depending on the specified conditions of the experiment. Each repeat used new dispersions of surfactant and water. The silver was filtered but not dried between consecutive exchanges. After the final exchange the silver was filtered and freeze-dried. The silver was then analyzed for extractable sodium ion contamination. The results are shown in Table 1 below and are graphically displayed in a contour map derived from the above-described experimental program (FIG. 1). The data showed that the most important variables were covariant, i.e., time of exchange and the polarity of the non-ionic surfactant varied inversely with each other. The number of times of exchange did not appear to be as significant. It is obvious, too, from the data in Table 1 and the contour map of the FIGURE that the more polar (higher HLB) surfactants were more effective in removing ion contamination at a given time of exchange. However, sufficient time of exchange allowed even the most non-polar surfactant to reduce sodium contamination significantly.

TABLE I

Correlation of Process Variables With Ion Extraction Level

| Example No. | Time Of Exchange (min.) | Number Of Exchanges | Surfactant Polarity (HLB no.) | Residual Sodium Ions (ppm by wt.) |
|---|---|---|---|---|
| Control* | — | — | — | 164 |
| 1 | 16 | 1 | 4.6 | 22 |
| 2 | 16 | 1 | 4.6 | 20 |
| 3 | 16 | 1 | 17.8 | 16 |
| 4 | 16 | 3 | 4.6 | 15 |
| 5 | 16 | 3 | 17.8 | 0 |
| 6 | 16 | 3 | 17.8 | 0 |
| 7 | 8 | 2 | 12.2 | 0 |
| 8 | 1 | 1 | 4.6 | 100 |
| 9 | 1 | 1 | 4.6 | 98 |
| 10 | 1 | 1 | 17.8 | 13 |
| 11 | 1 | 3 | 4.6 | 106 |
| 12 | 1 | 3 | 17.8 | 0 |

*Du Pont V9 silver flake was used as control and in each of the Examples.

EXAMPLE 13

A series of tests was carried out in which several one kilogram quantities of surfactant-treated flake silver were de-ionized by the process of the invention using the following procedure:

1. Non-ionic surfactant was dispersed in de-ionized water by means of a Lab Dispersator ® which is a high speed mixer operated at 10,000 rpm;

2. While dispersion of the surfactant was maintained by operating the mixer at 100 rpm, one kilogram of commercial grade flake silver powder was added to the dispersion;

3. The silver was thoroughly dispersed in the aqueous medium and the break-up of the micelles surrounding the particles was obtained by operating the mixer at 10,000 rpm for a time which was varied between 5 and 20 minutes; and 4. At the end of the preceding treating step, the powder was washed thoroughly two times with de-ionized water, filtered through a Nutch filter and then freeze-dried.

In using the above procedure for treatment of one kilogram batches of silver, the sodium ion content of the silver was in all cases reduced from 150 ppm to 0–20 ppm. In these tests, as in the tests of Examples 1–12 above, the extent of sodium ion removal was a function of the polarity (HLB) of the non-ionic surfactant which was used. Thus, relatively non-polar surfactants (HLB 3) yielded higher sodium ion impurity levels and more polar surfactants (HLB 18) yielded essentially zero sodium ion impurity levels. In addition, it was observed that the levels of other ionic impurities was also lowered substantially. For example, chloride ion levels of the treated silver particles were only 3–6 ppm.

Though sulfate levels of 25 ppm were indicated by the extractible ion analytical procedure used here, nevertheless that level of sulfate was determined to be the result of the oxidation of AgS during the procedure and not a measurement of actual sulfate ion content of the treated silver.

EXAMPLE 14

The process of the invention was carried out on a still larger scale in which 2.5 kg batches of flake silver particles were treated as follows:

In the first stage of the process, 75 g of Igepal CO 897 (HLB 17.8) were mixed with 3 liters of water. Two and half kg of Du Pont V9 silver flake were placed in the solution. The mixture was blended in a gallon-size Waring Blendor ® for 16 minutes. The silver was then separated from the surfactant solution by filtering and rinsed with deionized water until the rinse water had a conductivity of less than 10 microsiemens. The silver was then freeze-dried. Analysis of the silver showed no detectable extractable sodium. The percent solids of the final silver as measured by ignition at 750C showed 0.89% non-ionic surfactant remaining on the silver.

I claim:

1. A process for the de-ionization of surfactant-treated silver particles having a chemisorbed primary layer of ionic surfactant surrounded by a micellar secondary layer of ionic surfactant comprising the sequential steps of:

(1) forming a dispersion of non-ionic surfactant having an HLB number of at least 4 in an aqueous liquid medium;

(2) admixing in the dispersion of step (1) finely divided particles of surfactant-treated silver and maintaining a dispersion of both the non-ionic surfactant and silver particles in the aqueous liquid medium for a time sufficient to effect exchange between the dispersed non-ionic surfactant and the ionic surfactant in the micellar layer;

(3) separating from the aqueous liquid dispersion medium of step (2) surfactant-exchanged silver particles which contain residual water;

(4) washing the separated silver particles from step (3) with de-ionized water to remove ionic surfactant from the residual water; and (5) drying the washed silver particles from step (4).

2. The process of claim 1 in which the ionic surfactant adsorbed on the silver particles is sodium stearate.

3. The process of claim 1 in which the non-ionic surfactant is a poly(ethylene oxide) nonyl phenol.

4. The process of claim 1 in which the non-ionic surfactant HLB is 12–18.

5. The process of claim 1 in which the washed silver particles are freeze dried.

6. The process of claim 1 in which steps (1)–(4) are repeated one or more times prior to step (5).

* * * * *